US008927481B2

(12) United States Patent
O'Connell et al.

(10) Patent No.: US 8,927,481 B2
(45) Date of Patent: Jan. 6, 2015

(54) DETERGENTS OR CLEANING AGENTS HAVING A SOLID ENZYME FORMULATION

(71) Applicant: Henkel AG & Co. KGaA, Duesseldorf (DE)

(72) Inventors: Timothy O'Connell, Duesseldorf (DE); Susanne Tondera, Duesseldorf (DE); Hendrik Hellmuth, Duesseldorf (DE); Thomas Weber, Dormagen (DE); Thomas Eiting, Duesseldorf (DE); Johannes Bongaerts, Dormagen (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 14/053,557

(22) Filed: Oct. 14, 2013

(65) Prior Publication Data

US 2014/0038878 A1 Feb. 6, 2014

Related U.S. Application Data

(63) Continuation of application No. PCT/EP2012/056613, filed on Apr. 12, 2012.

(30) Foreign Application Priority Data

Apr. 18, 2011 (DE) ..... 10 2011 007 627

(51) Int. Cl.

| | |
|---|---|
| ***C11D 17/00*** | (2006.01) |
| ***C11D 17/06*** | (2006.01) |
| ***C11D 3/386*** | (2006.01) |
| ***C11D 7/42*** | (2006.01) |
| ***C11D 3/04*** | (2006.01) |
| ***C11D 3/12*** | (2006.01) |
| ***C11D 3/22*** | (2006.01) |
| ***C11D 3/37*** | (2006.01) |
| ***C11D 7/10*** | (2006.01) |
| ***C11D 7/14*** | (2006.01) |

(52) U.S. Cl.

CPC ..... *C11D 3/38672* (2013.01); *C11D 3/046* (2013.01); *C11D 3/1253* (2013.01); *C11D 3/221* (2013.01); *C11D 3/222* (2013.01); *C11D 3/225* (2013.01); *C11D 3/3707* (2013.01); *C11D 3/3753* (2013.01); *C11D 3/3757* (2013.01); *C11D 3/3776* (2013.01); *C11D 7/10* (2013.01); *C11D 7/14* (2013.01)

USPC ..... 510/445; 510/441; 510/320; 510/349; 510/392

(58) Field of Classification Search

USPC ..... 510/392, 349, 320, 445, 441

See application file for complete search history.

(56) References Cited

U.S. PATENT DOCUMENTS

| | | | | |
|---|---|---|---|---|
| 3,607,653 | A | 9/1971 | Ziffer et al. | |
| 4,740,469 | A * | 4/1988 | Nishinaka et al. | 510/530 |
| 4,940,665 | A * | 7/1990 | Iijima et al. | 435/187 |
| 6,001,639 | A | 12/1999 | Schulein et al. | |
| 6,417,151 | B1 | 7/2002 | Grothus et al. | |
| 7,300,782 | B2 | 11/2007 | Breves et al. | |
| 7,510,859 | B2 | 3/2009 | Wieland et al. | |
| 2002/0001835 | A1 | 1/2002 | Becker et al. | |
| 2003/0092097 | A1 | 5/2003 | Andersen et al. | |
| 2004/0033927 | A1 | 2/2004 | Simonsen et al. | |
| 2004/0259222 | A1 | 12/2004 | Breves et al. | |
| 2007/0111920 | A1 | 5/2007 | Baur et al. | |
| 2007/0128129 | A1 | 6/2007 | Stehr et al. | |
| 2008/0145353 | A1 | 6/2008 | Amin et al. | |
| 2009/0156454 | A1 | 6/2009 | Schmiedel et al. | |
| 2009/0163398 | A1 | 6/2009 | Miyamoto | |
| 2009/0170745 | A1 | 7/2009 | Merkel et al. | |
| 2009/0226560 | A1 * | 9/2009 | Marcussen et al. | 426/7 |
| 2009/0275493 | A1 | 11/2009 | Siegert et al. | |
| 2011/0065163 | A1 | 3/2011 | Becker et al. | |

FOREIGN PATENT DOCUMENTS

| | | | |
|---|---|---|---|
| EP | 1305432 | B1 | 9/2010 |
| GB | 1297461 | | 11/1972 |
| WO | 92/06165 | A1 | 4/1992 |
| WO | 97/14804 | A1 | 4/1997 |
| WO | 00/60060 | A2 | 10/2000 |
| WO | 01/46700 | A2 | 6/2001 |
| WO | 02/099091 | A2 | 12/2002 |
| WO | 2007/079938 | A2 | 7/2007 |
| WO | WO 2009102770 | A * | 8/2009 |

OTHER PUBLICATIONS

PCT International Search Report (PCT/EP2012/056613) dated Jul. 25, 2012.

Sumner, "Dinitrosalicylic Acid: A Reagent for the Estimation of Sugar in Normal and Diabetic Urine", Journal of Biological Chemistry, vol. 47, pp. 5-9, 1921.

Sumner, "The Estimation of Sugar in Diabetic Urine, Using Dinitrosalicylic Acid", Journal of Biological Chemistry, vol. 62, pp. 287-290, 1924.

Gornall et al., "Determination of Serum Proteins by Means of the Biuret Reaction", Journal of Biological Chemistry, vol. 177, pp. 751-766, 1948.

Van Raay et al, "The Determination of Proteolytic Activity in Enzyme Concentrates and Enzyme Containing Detergents", Tenside Detergents, vol. 7, No. 3, pp. 125-132, 1970.

Delmar et al., "A Sensitive New Substrate for Chymotrypsin", Analytical Biochemistry, vol. 99, pp. 316-320, 1979.

* cited by examiner

*Primary Examiner* — Lorna M Douyon

(74) *Attorney, Agent, or Firm* — Thomas G. Krivulka

(57) ABSTRACT

In a washing or cleaning agent that contains a solid enzyme formulation, the intention is to improve shelf stability in terms of enzymatic activity. This is achieved by a washing or cleaning agent comprising an enzyme granulate, the granulate comprising, besides the enzyme, the following components: (a) 68 to 90 wt % (w/w) sulfate, in particular alkali metal sulfate, particularly preferably sodium sulfate, (b) 0.1 to 10.5 wt % (w/w) polyethylene glycol, (c) 0.5 to 14.5 wt % (w/w) granulation adjuvant.

9 Claims, No Drawings

DETERGENTS OR CLEANING AGENTS HAVING A SOLID ENZYME FORMULATION

FIELD OF THE INVENTION

The present invention generally relates to enzyme-containing washing or cleaning agents, and more particularly relates to washing or cleaning agents that contain enzyme granulates.

BACKGROUND OF THE INVENTION

An extensive prior art exists regarding the formulation of sensitive washing- or cleaning-agent ingredients, in particular of enzymes in solid form. These include particles or (better, because they are made up of multiple ingredients) granulate grains (granules), which in total yield the formulated form of the granulate. For the manufacture of washing and cleaning agents it is usual to incorporate a very wide variety of ingredients in the form of granulates into corresponding agents, usually solid agents. One comparatively new development involves adding the sensitive ingredients in the form of solid granulates to liquid washing and cleaning agents as well.

Enzyme granulates are known in a multiplicity of embodiments in the existing art. German application DE 10 2006 018780, for example, discloses granulates of a sensitive washing- or cleaning-agent ingredient, in which context enzymes also represent such an ingredient. Commercially obtainable enzyme granulates are, for example, the enzyme preparations of the Novozymes company referred to as "T-granulates," or the enzyme preparations of the Danisco/Genencor company referred to as HS or D granulates.

A disadvantage of many enzyme granulates known in the existing art, however, is that they are not sufficiently stable in washing or cleaning agents. The washing or cleaning agent hence loses a considerable degree of enzymatic activity after only a short period of time. It is consequently not sufficiently shelf-stable in terms of residual enzymatic activity. The washing or cleaning agent then no longer exhibits optimum cleaning performance.

The underlying object of the present invention is to overcome the aforesaid disadvantage and to make available washing or cleaning agents having enzyme granulates that have sufficient improved shelf stability, in particular in terms of their enzymatic activity.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A washing or cleaning agent comprising an enzyme granulate, the granulate comprising, besides the enzyme, the following components: 68 to 90 wt % (w/w) sulfate, in particular alkali metal sulfate, particularly preferably sodium sulfate; 0.1 to 10.5 wt % (w/w) polyethylene glycol; 0.5 to 14.5 wt % (w/w) granulation adjuvant.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The subject matter of the invention is a washing or cleaning agent comprising an enzyme granulate, the granulate comprising, besides the enzyme, the following components:

(a) 68 to 90 wt % (w/w) sulfate, in particular alkali metal sulfate, particularly preferably sodium sulfate,
(b) 0.1 to 10.5 wt % (w/w) polyethylene glycol,
(c) 0.5 to 14.5 wt % (w/w) granulation adjuvant.

The enzyme granulate is contained in a washing or cleaning agent according to the present invention preferably in a quantity from 0.01 to 20 wt % (w/w), from 0.01 to 15 wt % (w/w), from 0.01 to 10 wt % (w/w), from 0.02 to 8 wt % (w/w), and from 0.03 to 5.0 wt % (w/w).

It has been found, surprisingly, that a washing or cleaning agent of this kind is advantageously shelf-stable. In particular, it exhibits higher residual enzymatic activity after storage, based on the initial enzymatic activity when storage began, as compared with a washing or cleaning agent that differs from an agent according to the present invention only in the formulation form of the enzyme. A different formulation form is yielded, for example, by the fact that the enzyme is present in the form of an enzyme granulate established in the existing art. Washing or cleaning agents that are particularly stable in terms of enzyme activity are consequently obtained by the use of such enzyme granulates in washing or cleaning agents, and the activities in agents according to the present invention of the enzyme components granulated in this manner are kept at a high level for a surprisingly long time. In advantageous embodiments of the invention, protection exists in particular with regard to bleaching agents contained in such agents. In further preferred embodiments of the invention, agents according to the present invention, in particular solid or powdered agents, and/or the enzyme granulates contained in the agents according to the present invention, exhibit good breakdown and dissolution behavior and enable rapid release of the substances contained, practically without leaving behind residues on the material being washed or cleaned.

Preferred embodiments of an agent according to the present invention further exhibit good, in particular advantageous, cleaning performance on at least one, preferably several stains that are sensitive to degradation by the enzyme. Such cleaning performance by preference occurs also at low temperatures, for example between 10° C. and 50° C., preferably between 10° C. and 40° C., or between 20° C. and 40° C. Such an agent therefore enables satisfactory or improved removal of at least one, preferably several enzyme-sensitive stains on textiles and/or hard surfaces, for example dishes.

The enzyme granulate contained in agents according to the present invention comprises, as component (a), from 68 to 90 wt % (w/w), from 68.5 to 87 wt % (w/w), from 69 to 84 wt % (w/w), from 69.5 to 81 wt % (w/w), from 70 to 80 wt % (w/w), or from 71 to 78 wt % (w/w) sulfate. The sulfate is by preference an alkali metal sulfate, in particular lithium sulfate, sodium sulfate, or potassium sulfate or mixtures thereof. The sulfate is particularly preferably sodium sulfate.

The enzyme granulate contained in agents according to the present invention further comprises polyethylene glycol (PEG) as component (b), in a quantity from 0.1 to 10.5 wt % (w/w), from 0.2 to 8 wt % (w/w), from 0.3 to 5 wt % (w/w), from 0.4 to 3 wt % (w/w), from 0.5 to 2 wt % (w/w), or from 0.6 to 1 wt % (w/w). Depending on chain length, polyethylene glycols are liquid or solid, chemically inert, water-soluble polymers that can be manufactured by polymerizing ethylene oxide by alkaline catalysis. A variety of polyethylene glycols having different average molecular weights are commercially available; PEGs having low average molecular weights also have the lowest melting points. Polyethylene glycols having an average molecular weight between 200 and 400 are non-volatile liquids at room temperature. PEG 600 has a melting range from 17 to 22° C. and thus has a pasty consistency. At molecular weights above 3000, PEGs are solid substances and are often marketed as flakes or powders. The hardness and melting range rise with increasing molecular weight. Examples of usable PEGs are PEG 1500, PEG 3000, PEG 4000, PEG 6000, PEG 9000, for example of the BASF company. Consideration can further be given, in order to obtain a desired density and/or a desired melting point for the granulate, to using mixtures of PEGs having a low melting point and a high melting point. Alternatively, mixtures of PEGs having a low melting point or a high melting point with further waxes having a high melting point or low melting point can be used.

The molar masses indicated are, for purposes of this document, weight-average molar masses Mw that were determined in principle by means of gel permeation chromatography (GPC), a UV detector having been used. The measurement was performed against an external standard that yields realistic molar weight values because of its structural affinity with the polymers being investigated.

The enzyme granulate contained in agents according to the present invention further comprises a granulation adjuvant as component (c), in a quantity from 0.5 to 14.5 wt % (w/w), from 1 to 12 wt % (w/w), from 2 to 10 wt % (w/w), from 3 to 8.5 wt % (w/w), from 4 to 8 wt % (w/w), or from 5 to 8 wt % (w/w). A granulation adjuvant is a compound that is capable of forming a solid formulation form together with the enzyme and with components (a) and (b). Among the preferred granulation adjuvants are in particular cellulose and sheet silicates, for example bentonite or smectite. Further preferred granulation adjuvants are furthermore those that contain at least one water-soluble organic polymer, in particular cellulose ethers and starch ethers such as carboxymethyl cellulose, carboxymethyl starch, methyl cellulose, hydroxyethyl cellulose, hydroxypropyl cellulose, as well as corresponding cellulose mixed ethers. Gelatin, casein, tragacanth, maltodextrose, sucrose, invert sugar, glucose syrup, or other water-soluble or readily dispersible oligomers or polymers of natural origin can optionally also be used. Usable synthetic water-soluble polymers are polyacrylates, polymethacrylates, copolymers of acrylic acid with maleic acid or vinyl-group-containing compounds, furthermore polyvinyl alcohol, partially saponified polyvinyl acetate, and polyvinylpyrrolidone. If the aforesaid compounds are those having free carboxyl groups, they are normally present in the form of their sodium salts. Component (c) is very particularly preferably cellulose.

In a further embodiment of the invention, a washing or cleaning agent according to the present invention is characterized in that the enzyme granulate further comprises a color pigment. Color pigments serve to improve the visual appearance of the granulates, and can also have a positive effect on the plasticity of the granulate. The color pigment is by preference titanium dioxide. The color pigment is contained in the enzyme granulate by preference in a quantity from 2 to 6 wt % (w/w), from 2.5 to 5 wt % (w/w), or from 3 to 4.5 wt % (w/w).

In a further embodiment of the invention, a washing or cleaning agent according to the present invention is characterized in that the enzyme granulate further comprises kaolin. Kaolin is contained in the enzyme granulate by preference in a quantity from 0.1 to 2.5 wt % (w/w), from 0.3 to 3 wt % (w/w), from 0.35 to 1 wt % (w/w), or from 0.4 to 0.8 wt % (w/w).

An enzyme granulate particularly preferred in agents according to the present invention comprises sodium sulfate as component (a), PEG as component (b), and cellulose as component (c). An enzyme granulate very particularly preferred in agents according to the present invention encompasses from 71 to 78 wt % (w/w) sodium sulfate as component (a), from 0.6 to 1 wt % (w/w) PEG as component (b), and from 5 to 8 wt % (w/w) cellulose as component (c).

A further enzyme granulate very particularly preferred in agents according to the present invention comprises 71 to 78 wt % (w/w) sodium sulfate as component (a), from 0.6 to 1 wt % (w/w) PEG as component (b), from 5 to 8 wt % (w/w) cellulose as component (c), from 3 to 4.5 wt % (w/w) titanium dioxide, and from 0.4 to 0.8 wt % (w/w) kaolin.

Be it noted at this juncture that the above-indicated ingredients of the granulate are based on the total granulate, and are to be regarded as being independent of the construction of the granulate. For example, it is possible for the granulates to have a structure made up of a granulate core and an envelope (coating), so that the granulate components indicated can be present in the core and/or in the envelope. All indications as to ingredients and quantities therefore refer to the total granulate, i.e. for example including one or more envelope layers.

The enzyme granulates can moreover comprise further carriers and/or enveloping substances. The further carriers and/or enveloping substances are selected by preference from the group encompassing salts such as sulfates, phosphates, carbonates, in particular calcium carbonate, acetates; organic and inorganic acids such as citric acid, tartaric acid, malic acid, alginic acid, glutamic acid; sugars such as saccharose, glucose, fructose, sorbitol, lactose, sucrose; starch compounds such as potato starch, corn starch, rice starch, manioc starch, locust bean flour, cyclodextrins, dextrin, algin, gelatin; silicates such as water glass, zeolites, metasilicates, soda silicates; silicic acids; surfactants such as alkylbenzenesulfonates, fatty alcohol sulfate, stearates, and/or urea.

The enzyme granulate contained in agents according to the present invention comprises at least one enzyme but can also encompass multiple enzymes. In principle, all enzymes established in the existing art for these purposes are usable in this regard. These are by preference one or more enzymes that can display catalytic activity in a washing or cleaning agent according to the present invention, in particular a protease, amylase, lipase, cellulase, hemicellulase, mannanase, pectin-cleaving enzyme, tannase, xylanase, xanthanase, β-glucosidase, carrageenase, perhydrolase, oxidase, oxidoreductase, and mixtures thereof.

Among the proteases, those of the subtilisin type are preferred. Examples thereof are the subtilisins BPN' and Carlsberg, protease PB92, subtilisins 147 and 309, the alkaline protease from *Bacillus lentus*, subtilisin DY, and the enzymes (to be classified, however, as subtilases and no longer as subtilisins in the strict sense) thermitase, proteinase K, and the proteases TW3 and TW7. Subtilisin Carlsberg is obtainable in further developed form under the trade name Alcalase® from Novozymes A/S, Bagsværd, Denmark. Subtilisins 147 and 309 are marketed by Novozymes under the trade names Esperase® and Savinase®. The protease variants listed under the designation BLAP® are derived from the protease from *Bacillus lentus* DSM 5483. Further preferred proteases are moreover, for example, the enzymes marketed under the designation PUR. Further proteases are the enzymes obtainable under the trade names Durazym®, Relase®, Everlase®, Nafizym®, Natalase®, Kannase®, and Ovozyme® from Novozymes, under the trade names Purafect®, Purafect® OxP, Purafect® Prime, Excellase®, and Properase® from Genencor, under the trade name Protosol® from Advanced Biochemicals Ltd., Thane, India, under the trade name Wuxi® from Wuxi Snyder Bioproducts Ltd., China, under the trade names Proleather® and Protease P° from Amano Pharmaceuticals Ltd., Nagoya, Japan, and under the designation Proteinase K-16 from Kao Corp., Tokyo, Japan. The proteases from *Bacillus gibsonii* and *Bacillus pumilus*, which are disclosed in international patent applications WO 2008/086916 and WO 2007/131656, are also used with particular preference.

Amylases that can be formulated according to the present invention are, for example, the α-amylases from *Bacillus licheniformis*, from *Bacillus amyloliquefaciens*, or from *Bacillus stearothermophilus*, including in particular the further developments thereof improved for use in washing or cleaning agents. The enzyme from *Bacillus licheniformus* is available from the Novozymes company under the name Termamyl®, and from Danisco/Genencor under the name Purastar® ST. Further developed products of this α-amylase are available from Novozymes under the trade names Duramyl® and Termamyl® ultra, from Danisco/Genencor under the name Purastar® OxAm, and from Daiwa Seiko Inc., Tokyo, Japan, as Keistase®. The α-amylase from *Bacillus amyloliquefaciens* is marketed by Novozymes under the name BAN®, and derived variants of the α-amylase from *Bacillus stearothermophilus* are marketed, likewise by Novozymes, under the names BSG® and Novamyl®. Additionally to be highlighted for this purpose are the α-amylase from *Bacillus* sp. A 7-7 (DSM 12368) and the cyclodextrin-glucanotransferase (CGTase) from *Bacillus agaradherens* (DSM 9948). Fusion products of all the aforesaid molecules are likewise usable. The further developments of the α-amylase from *Aspergillus niger* and *A. oryzae*, obtainable from Novozymes under the trade names Fungamyl®, are also suitable. Further advantageously usable commercial products are, for example, Amylase-LT® and Stainzyme® or Stainzyme Ultra® or Stainzyme Plus®, the latter likewise from Novozymes. Variants of these enzymes obtainable by point mutations can also be used according to the present invention. Particularly preferred amylases are disclosed in the international patent applications WO 00/60060, WO 03/002711, WO 03/054177, and WO 07/079,938, to whose disclosure reference is therefore expressly made, whose disclosure content relevant hereto is therefore expressly incorporated into the present patent application. Amylases that can be formulated according to the present invention are furthermore preferably α-amylases.

Examples of lipases or cutinases that can be formulated according to the present invention, which are contained in particular because of their triglyceride-cleaving activity but also in order to generate peracids in situ from suitable precursors, are the lipases obtainable originally from *Humicola lanuginosa* (*Thermomyces lanuginosus*) or further developed lipases, in particular those having the D96L amino acid exchange. They are marketed, for example, by the Novozymes company under the trade names Lipolase®, Lipolase® Ultra, LipoPrime®, Lipozyme®, and Lipex®. Also usable, for example, are the cutinases that were originally isolated from *Fusarium solani pisi* and *Humicola insolens*. The lipases respectively cutinases from, for example, the Danisco/Genencor company, whose starting enzymes were originally isolated from *Pseudomonas mendocina* and *Fusarium solanii*, are also usable. To be mentioned as further important commercial products are the formulations M1 Lipase® and Lipomax® originally marketed by the Gist-Brocades company, and the enzymes marketed by Meito Sangyo K K, Japan, under the names Lipase MY-30®, Lipase OF®, and Lipase PL®, as well as the Lumafast® product of the Genencor company.

Cellulases can be contained in enzyme granulates of washing or cleaning agents according to the present invention, depending on the purpose, as pure enzymes, as enzyme preparations, or in the form of mixtures in which the individual components advantageously complement one another in terms of their various performance aspects. Among these performance aspects are, in particular, contributions to primary washing performance, to the secondary washing performance of the agent (anti-redeposition effect or anti-gray), to avivage (fabric effect), or even the exertion of a "stone-washed" effect.

Cellulases (endoglucanases, EG) that can be formulated according to the present invention comprise, for example, the fungus-based cellulase preparation rich in endoglucanase (EG), or its further developments, offered by the Novozymes company under the trade name Celluzyme®. The products Endolase® and Carezyme®, likewise obtainable from the Novozymes company, are based on the 50 kD EG and 43 kD EG, respectively, from *Humicola insolens* DSM 1800. Further usable commercial products of this company are Cellusoft®, Renozyme®, and Celluclean®. Also usable are, for example, cellulases that are available from the AB Enzymes company, Finland, under the trade names Ecostone® and Biotouch® and that are based at least in part on the 20 kD EG from Melanocarpus. Further cellulases of the AB Enzymes company are Econase® and Ecopuip®. Other suitable cellulases are from *Bacillus* sp. CBS 670.93 and CBS 669.83, the one from *Bacillus* sp. CBS 670.93 being obtainable from the Danisco/Genencor company under the trade name Puradax®. Further usable commercial products of the Danisco/Genencor company are "Genencor detergent cellulase L" and Indi-Age® Neutra.

Variants of these enzymes obtainable by point mutations can also be used according to the present invention. Particularly preferred cellulases are *Thielavia terrestris* cellulase variants that are disclosed in international application WO 98/12307; cellulases from Melanocarpus, in particular Melanocarpus albomyces, that are disclosed in international application WO 97/14804; cellulases of the EGIII type from *Trichoderma reesei* that are disclosed in European patent application EP 1 305 432 or variants obtainable therefrom, in particular those that are disclosed in European patent applications EP 1240525 and EP 1305432; as well as cellulases that are disclosed in international applications WO 1992006165, WO 96/29397, and WO 02/099091. Reference is therefore expressly made to their respective disclosures, their disclosure content relevant hereto is therefore expressly incorporated into the present patent application.

Enzymes grouped under the term "hemicellulases" can furthermore be used in enzyme granulates of washing or cleaning agents according to the present invention, in particular in order to remove certain problem stains. These include, for example, mannanases, xanthanlyases, xyloglucanases, xylanases, xanthanases, pullulanases, pectin-cleaving enzymes, and β-glucanases. The β-glucanase recovered from *Bacillus subtilis* is available under the name Cereflo® from the Novozymes company. Hemicellulases particularly preferred according to the present invention are mannanases, which are marketed e.g. under the trade names Mannaway® by Novozymes or Purabrite® by Danisco/Genencor. Likewise included among the pectin-cleaving enzymes in the context of the present invention are enzymes having the designations pectinase, pectate lyase, pectin esterase, pectin demethoxylase, pectin methoxylase, pectin methylesterase, pectase, pectin methylesterase, pectinoesterase, pectin pectylhydrolase, pectin depolymerase, endopolygalacturonase, pectolase, pectin hydrolase, pectin polygalacturonase, endopolygalacturonase, poly-α-1,4-galacturonide glycanohydrolase, endogalacturonase, endo-D-galacturonase, galacturan 1,4-α-galacturonidase, exopolygalacturonase, poly(galacturonate) hydrolase, exo-D-galacturonase, exo-D-galacturonanase, exopoly-D-galacturonase, exopoly-α-galacturonosidase, exopolygalacturonosidase, or exopolygalacturanosidase. Examples of enzymes suitable in this context are obtainable, for example, under the names Gamanase®, Pektinex AR®, X-Pect®, or Pectaway® from the Novozymes company, under the name Rohapect UF®, Rohapect TPL®, Rohapect PTE100®, Rohapect MPE®, Rohapect M A plus HC, Rohapect DA12L®, Rohapect 10L®, Rohapect® B1L from the AB Enzymes company, and under the name Pyrolase® from Diversa Corp., San Diego, Calif., USA.

Oxidoreductases, for example oxidases, oxygenases, catalases (which react as peroxidases at low $H_2O_2$ concentrations), peroxidases such as halo-, chloro-, bromo-, lignin, glucose, or manganese peroxidases, dioxygenases, or laccases (phenoloxidases, polyphenoloxidases), can be contained in enzyme granulates of washing or cleaning agents according to the present invention in order to intensify the bleaching effect. Denilite® 1 and 2 of the Novozymes company may be recited as suitable commercial products. Reference is made to applications WO 98/45398 A1, WO 2005/056782 A2, and WO 2004/058961 A1 as examples of advantageously usable systems for enzymatic perhydrolysis. A combined enzymatic bleaching system encompassing an oxidase and a perhydrolase is described in application WO 2005/124012.

The enzymes to be used according to the present invention can furthermore be formulated in enzyme granulates of washing or cleaning agents according to the present invention together with accompanying constituents, for example from fermentation, or with stabilizers, and can be incorporated in that form into a washing or cleaning agent according to the present invention.

Shelf stability for purposes of the invention exists, when a washing or cleaning agent according to the present invention exhibits, after storage, higher residual activity of the enzyme, based on initial enzyme activity when storage began, as compared with a control composition that differs from an agent according to the present invention only in terms of the formulation form of the enzyme, in particular such that the enzyme is present in the form of an enzyme granulate established in the existing art, by preferences as a commercially usual T-granulate of the Novozymes company. The two agents are processed in the same manner, in particular with regard to storage conditions and the determination of enzyme activity. Storage occurs, with increasing preference, for at least 24 hours, 48 hours, 72 hours, 5 days, 1 week, 2 weeks, 3 weeks, 4 weeks, or 8 weeks. Also preferably, storage occurs at a temperature of 20° C., 25° C., or 30° C., particularly preferably at 30° C. Particularly preferably, the existence of shelf stability for purposes of the present invention is ascertained as indicated above, using a washing or cleaning agent that is stored for eight weeks at a temperature of 30° C. Very particularly preferably, the enzyme is a protease or an amylase.

The determination of enzyme activity can occur in this regard, coordinated with the respective type of enzyme, in a manner usual in the art. Methods for determining activity are familiar to one skilled in the art of enzyme technology, and are routinely utilized by him or her. Methods for determining protease activity are disclosed, for example, in Tenside, Vol. 7 (1970), pp. 125-132. Proteolytic activity can furthermore be determined by way of the release of the para-nitroaniline (pNA) chromophore from the suc-L-Ala-L-Ala-L-Pro-L-Phe-p-nitroanilide substrate (suc-AAPF-pNA). The protease cleaves the substrate and releases pNA. The release of pNA causes an increase in extinction at 410 nm, the time course of which is an indication of enzymatic activity (see Del Mar et al., 1979). Measurement is performed at a temperature of 25° C., at pH 8.6 and a wavelength of 410 nm. The measurement time is 5 min, with a measurement interval from 20 s to 60 s.

Amylase activity is determined in a manner usual in the art. Amylase activity is preferably determined as indicated below. Amylases convert starch to glucose. Under defined reaction conditions (tris-maleate buffer pH 6.5, 50° C., 15 min), the samples to be investigated are incubated with 0.67% starch (soluble, pretreated per Zulkowsky (treated with glycerol at 190° C.)). Adding dinitrosalicylic acid and heating to 100° C. causes this to be reduced by glucose and other reducing sugars under alkaline conditions to a red-orange dye, which is determined photometrically at a wavelength of 540 nm after completion of the reaction. The quantity of released sugar corresponding to the color is an indication of the enzyme activity (cf. Sumner et al., J. Biol. Chem., 1921, 47 and 1924, 62).

In a preferred embodiment of the invention, a washing or cleaning agent according to the present invention is characterized in that the enzyme is present in the enzyme granulate in a quantity from 2 to 30 wt % (w/w), from 3 to 25 wt % (w/w), from 4 to 20 wt % (w/w), from 5 to 15 wt % (w/w), or from 6 to 14 wt % (w/w). In the present application, all weight indications with regard to enzymes in the enzyme granulates are based on the dry substance content of the enzyme preparation.

The protein concentration can be determined with the aid of known methods, for example the BCA method (bicinchoninic acid; 2,2'-biquinolyl-4,4'-dicarboxylic acid) or the biuret method (A. G. Gornall, C. S. Bardawill and M. M. David, J. Biol. Chem., 177 (1948), pp. 751-766).

In a further embodiment of the invention, a washing or cleaning agent according to the present invention is characterized in that the granulate is substantially free of carbonate. Such embodiments of the granulates are furthermore preferably notable for a high proportion of component (a). Such embodiments of the granulates by preference contain at least 71 wt % (w/w), at least 72 wt % (w/w), at least 73 wt % (w/w), at least 74 wt % (w/w), at least 75 wt % (w/w), or at least 76 wt % (w/w) component (a). "Substantially free" means that carbonates were not deliberately used for manufacturing the enzyme granulate. Carbonates can consequently still be present at most as residues, for example from microbial fermentation or from the enzyme preparation prior to granulation. Carbonates are therefore contained in the enzyme granulate by preference at less than 7 wt % (w/w), and with increasing preference less than 6 wt % (w/w), 5 wt % (w/w), 4 wt % (w/w), 3 wt % (w/w), 2 wt % (w/w), 1 wt % (w/w), and 0.5 wt % (w/w).

In a further embodiment of the invention, a washing or cleaning agent according to the present invention is characterized in that the enzyme granulate comprises at least one core and at least one envelope surrounding the core. The terms "envelope" and "coating" are to be regarded as synonyms.

This envelope can serve in particular as additional protection for the enzymes, but can also serve other purposes, for example to delay or accelerate release of the enzyme; to improve bulk material properties, for example to lower the dusting rate; to increase stability; and/or to improve visual appearance.

An enzyme granulate of this kind can furthermore be embodied in such a way that the envelope constitutes from 1.5 to 900 wt % and, with increasing preference, from 3 to 750 wt %, from 6 to 600 wt %, from 7.5 to 450 wt %, from 10.5 to 300 wt %, and particularly preferably from 15 to 150 wt % of the granulate core. A weight ratio of this kind between envelope and granulate core can be further advantageous for the stability of the granulate. This indication refers to the completely formulated granulate. These values may still be slightly different at the time of manufacture, since granulates are usually subjected to a further drying step even after they are coated. The water content of both the core and the coating decreases in this context, with the result that differences in the ratio of water contents among them can also occur. This is the case, for example, when comparatively dilute, i.e. particularly aqueous enzyme preparations have been incorporated into the core, or when coating has been performed with an aqueous suspension of an inherently hydrophobic coating material. In the latter case the water content of the envelope that is ultimately obtained is appreciably lower than that of the core.

In a further embodiment, an enzyme granulate of this kind comprises an envelope having an average layer thickness of at least 5 μm. The layer thickness can also be at least 10 μm, 20 μm, 30 μm, 40 μm, 50 μm, 60 μm, 70 μm, 80 μm, 90 μm, or 100 μm. A sufficient average minimum layer thickness can be additionally advantageous for the stability of the granulate.

The enzyme granulate can comprise more than one envelope. This is understood to mean that, for example, multiple envelopes, which can differ in terms of their composition, are applied onto a core material. Also to be understood thereby is the situation in which an envelope comprises different layers that can differ, for example, in terms of their different compositions. Envelopes can thus be differentiated, for example, on the basis of their composition and/or on the basis of their average spacing from the granulate core and/or on the basis of their sequential application onto the granulate. The above-described layer thicknesses and quantity indications refer to each envelope that is present, i.e. in the case in which two or more envelope layers are present, each layer can have the indicated layer thickness and can be present in the quantities indicated.

Optional ingredients of the envelope will be described below. No distinction is made here between different envelopes, so that each envelope can contain these ingredients.

The envelope can contain one or more further plasticizers. These plasticizers are preferably selected from the group consisting of 1,2-propylene glycol, triethyl citrate, triacetin, further polyfunctional alcohols, and polyethylene glycol.

The envelope can furthermore contain one or more fillers selected from the group of the inorganic particles, by preference silicate, silicic acid, titanium dioxide, or aluminum oxide, particularly preferably talc. Such fillers can serve, for example, to influence the overall plasticity of the relevant coating and/or of the particles obtained, to improve their diffusion sealing, or to regulate the bulk density of the particles.

The envelope can furthermore contain one or more compounds acting as an antioxidant. Antioxidants are known per se to one skilled in the art. It is thus possible, for example, to increase the stability of enzymes, in particular with regard to oxidative breakdown, using sulfur-containing reducing agents, sodium sulfite, and/or reducing sugars. Further compounds to be recited at this juncture as suitable are, for example, ascorbic acid, tocopherol, gallates, thiosulfates, substituted phenols, hydroquinones, pyrocatechols, and aromatic amines, as well as organic sulfides, polysulfides, dithiocarbamates, phosphites, phosphonates, and vitamin E.

Washing or cleaning agents or laundry post-treatment agents according to the present invention preferably contain, besides the enzyme granulate, at least one, by preference multiple active components, in particular components having washing, care-providing, and/or cleaning activity, advantageously selected from the group comprising anionic surfactants, cationic surfactants, amphoteric surfactants, nonionic surfactants, acidifying agents, alkalizing agents, anticrease compounds, antibacterial substances, antioxidants, antiredeposition agents, antistatic agents, builder substances, bleaching agents, bleach activators, bleach stabilizers, bleach catalysts, ironing adjuvants, fragrances, shrinkage preventers, electrolytes, enzymes, color protectants, dyes, color transfer inhibitors, fluorescent agents, fungicides, germicides, odor-complexing substances, hydrotropes, rinse aids, complexing agents, preservatives, corrosion inhibitors, optical brighteners, luster agents, pH adjusting agents, proofing and impregnation agents, polymers, swelling and anti-slip agents, foam inhibitors, sheet silicates, dirt-repelling substances (soil-release active substances), silver protectants, silicone oils, UV protection substances, viscosity regulators, thickening agents, discoloration inhibitors, anti-gray agents, vitamins, and/or avivage active substances.

The quantities of the further possible ingredients in the washing or cleaning agents or laundry post-treatment agents according to the present invention are aimed in each case toward the intended use of the relevant agents, and one skilled in the art is familiar in principle with the orders of magnitude of the quantities of optional ingredients to be used, or can gather them from the relevant technical literature.

In a preferred embodiment of the invention the washing or cleaning agent is consequently characterized in that it comprises a further ingredient that is selected from the group consisting of surfactant, builder, peroxygen compound, bleach activator, optical brightener, foam inhibitor, soil-release active substance, color transfer inhibitor, anti-gray agent, organic solvent, acid, or base.

A combination of the enzyme granulate with one or more of the further ingredient(s) of the agent is particularly advantageous because such an agent exhibits improved cleaning performance due to resulting synergies. In preferred embodiments of agents according to the present invention, synergistic cleaning performance is achieved in particular thanks to combination of the enzyme granulate with one of the surfactants described below and/or with one of the builders described below and/or with one of the peroxygen compounds described below and/or with one of the bleach activators described below and/or with one of the optical brighteners described below and/or with one of the foam inhibitors described below and/or with one of the soil-release active substances described below.

The washing or cleaning agents or laundry post-treatment agents according to the present invention can by preference contain surfactants; anionic surfactants, nonionic surfactants, and mixtures thereof, but also cationic surfactants, are appropriate in particular.

Among the optionally usable nonionic surfactants are the alkoxylates, in particular ethoxylates and/or propoxylates, of saturated or mono- to polyunsaturated linear or branched-chain alcohols having 10 to 22 carbon atoms, by preference 12 to 18 carbon atoms. The degree of alkoxylation of the alcohols is as a rule between 1 and 20, by preference between 3 and 10. They can be manufactured, in known fashion, by reacting the corresponding alcohols with the corresponding alkylene oxides. The derivatives of the fatty alcohols are particularly suitable, although their branched-chain isomers, in particular so-called oxo alcohols, can also be used to manufacture usable alkoxylates. The alkoxylates, in particular the ethoxylates, of primary alcohols having linear, in particular dodecyl, tetradecyl, hexadecyl, or octadecyl residues, and mixtures thereof, are accordingly usable. Also usable are corresponding alkoxylation products of alkylamines, of vicinal diols, and of carboxylic acid amides that correspond to the aforesaid alcohols in terms of the alkyl portion. Additionally suitable are the ethylene-oxide and/or propylene-oxide insertion products of fatty acid alkyl esters, as well as fatty acid polyhydroxyamides.

So-called alkylpolyglycosides suitable for incorporation into the agents according to the present invention are compounds of the general formula $(G)_n$-$OR^8$, in which $R^8$ signifies an alkyl or alkenyl residue having 8 to 22 carbon atoms, G a glycose unit, and n a number between 1 and 10. The glycoside component $(G)_n$ refers to oligomers or polymers from naturally occurring aldose or ketose monomers, among which are included, in particular, glucose, mannose, fructose, galactose, talose, gulose, altrose, allose, idose, ribose, arabinose, xylose, and lyxose. The oligomers made up of glycosidically linked monomers of this kind are characterized not only by the nature of the sugars contained in them but also by their number (the so-called degree of oligomerization). The degree of oligomerization n, constituting a magnitude to be ascertained analytically, generally assumes fractional numerical values; its value is between 1 and 10, below a value of 1.5 for the glycosides preferably used, in particular between 1.2 and 1.4. Because of its good availability, glucose is a preferred monomer module. The alkyl or alkenyl portion $R^8$ of the glycosides preferably likewise derives from easily accessible derivatives of renewable raw materials, in particular from fatty alcohols, although their branched-chain isomers, in particular so-called oxo alcohols, can also be used to manufacture usable glycosides. The primary alcohols having linear octyl, decyl, dodecyl, tetradecyl, hexadecyl, or octadecyl residues, and mixtures thereof, are accordingly usable in particular. Particularly preferred alkylglycosides contain a coconut oil alkyl residue, i.e. mixtures where substantially $R^8$=dodecyl and $R^8$=tetradecyl.

Nonionic surfactant is optionally contained in washing or cleaning agents according to the present invention by preference in quantities from 0.1 wt % to 30 wt %, in particular from 1 wt % to 25 wt %, "wt %" being based on the total washing or cleaning agent.

The washing or cleaning agents can instead or additionally contain further optional surfactants, by preference anionic surfactants.

Anionic surfactants of the sulfate or sulfonate type are by preference optionally contained, in quantities by preference not above 30 wt %, in particular from 0.1 wt % to 18 wt %, based in each case on the total washing or cleaning agent. Anionic surfactants particularly suitable for use in the washing or cleaning agents according to the present invention are the alkyl and/or alkenyl sulfates, having 8 to 22 carbon atoms, which carry an alkali-, ammonium-, or alkyl- or hydroxyalkyl-substituted ammonium ion as counter-cation. The derivatives of fatty alcohols having, in particular, 12 to 18 carbon atoms, and their branched-chain analogs (the so-called oxo alcohols), are preferred. The alkyl and alkenyl sulfates can be manufactured in known fashion by reacting the corresponding alcohol component with a usual sulfating reagent, in particular sulfur trioxide or chlorosulfonic acid, followed by neutralization with alkali-, ammonium-, or alkyl- in particular hydroxyalkyl-substituted ammonium bases. Such alkyl and/or alkenyl sulfates are optionally contained in the washing or cleaning agents by preference in quantities from 0.1 wt % to 20 wt %, in particular from 0.5 wt % to 18 wt %.

Also included among the usable surfactants of the sulfate type are sulfated alkoxylation products of the aforesaid alcohols (so-called ether sulfates). Such ether sulfates contain by preference 2 to 30, in particular 4 to 10 ethylene glycol groups per molecule. Included among the usable anionic surfactants of the sulfonate type are the α-sulfo esters obtainable by reacting fatty acid esters with sulfur trioxide and subsequent neutralization, in particular the sulfonation products deriving from fatty acids having 8 to 22 carbon atoms, by preference 12 to 18 carbon atoms, and linear alcohols having 1 to 6 carbon atoms, by preference 1 to 4 carbon atoms, and the sulfofatty acids proceeding therefrom by formal saponification.

Anionic surfactants optionally usable with particular preference are alkylbenzenesulfonates, such as e.g. sodium dodecylbenzenesulfonate.

Anionic surfactant is optionally contained in washing or cleaning agents according to the present invention by preference in quantities from 0.1 wt % to 30 wt %, in particular from 1 wt % to 25 wt %, "wt %" being based on the total washing or cleaning agent.

Further appropriate optionally usable surfactant ingredients of the washing or cleaning agents are soaps; saturated fatty acid soaps such as the salts of lauric acid, myristic acid, palmitic acid, or stearic acid, as well as soaps derived from natural fatty acid mixtures, for example coconut, palm-kernel, or tallow fatty acids, are suitable. Those soap mixtures that are made up of 50 wt % to 100 wt % saturated $C_{12}$ to $C_{18}$ fatty acid soaps and up to 50 wt % oleic acid soap are particularly preferred. Soap is optionally contained in the washing or cleaning agents according to the present invention by preference in quantities from 0.1 wt % to 5 wt %. Larger quantities of soap up to 20 wt % can, however, also be contained in particular in liquid washing or cleaning agents.

Cationic surfactants can also be optionally contained in the washing or cleaning agents according to the present invention. Examples of cationic surfactants are quaternary ammonium compounds having by preference one or, in particular, two hydrophobic alkyl residues. Esterquats are particularly preferred, i.e. quaternary ammonium compounds having two hydrophobic residues that each contain an ester group as a "defined break point" for easier biodegradability. Esterquats preferred for use are methyl-N-(2-hydroxyethyl)-N,N-di(tallowacyloxyethyl)ammonium methosulfate, bis-(palmitoyloxyethyl)hydroxyethylmethylammonium methosulfate, 1,2-bis-[tallowacyloxy]-3-trimethylammonium propane chloride, N,N-dimethyl-N,N-di(tallowacyloxyethyl)ammonium methosulfate, or methyl-N,N-bis(stearoyloxyethyl)-N-(2-hydroxyethyl)ammonium methosulfate. The cationic surfactants are contained in the agents according to the present invention optionally in quantities by preference from 0.05 to 20 wt %, based on the entire agent. Quantities from 0.1 to 5 wt % are particularly preferred.

According to a preferred embodiment of the invention, surfactants are contained in washing or cleaning agents according to the present invention in a total quantity by preference from 5 wt % to 50 wt %, in particular from 8 wt % to 30 wt %. In laundry post-treatment agents in particular, by preference up to 30 wt %, in particular 5 wt % to 15 wt % surfactants are used, among them preferably cationic surfactants at least in part.

A washing or cleaning agent according to the present invention can by preference contain at least one builder, by preference a water-soluble and/or water-insoluble, organic and/or inorganic builder. The use of water-soluble builders is preferred.

Included among the water-soluble organic builder substances are polycarboxylic acids, in particular citric acid and sugar acids, monomeric and polymeric aminopolycarboxylic acids, in particular methylglycinediacetic acid, nitrilotriacetic acid, and ethylenediaminetetraacetic acid, as well as polyaspartic acid, polyphosphonic acids, in particular aminotris (methylenephosphonic acid), ethylenediaminetetrakis (methylenephosphonic acid), and 1-hydroxyethane-1,1-diphosphonic acid, polymeric hydroxy compounds such as dextrin, as well as polymeric (poly)carboxylic acids, polymeric acrylic acids, methacrylic acids, maleic acids, and mixed polymers thereof, which can also contain, polymerized into them, small proportions of polymerizable substances having no carboxylic-acid functionality. Compounds of this class that are suitable although less preferred are copolymers of acrylic acid or methacrylic acid with vinyl ethers, such as vinyl methyl ethers, vinyl esters, ethylene, propylene, and styrene, in which the proportion of acid is at least 50 wt %.

Organic builder substances can be contained, if desired, in the washing or cleaning agents according to the present invention in quantities of up to 40 wt %, in particular up to 25 wt %, and by preference from 1 wt % to 8 wt %. Quantities close to the aforesaid upper limit are used by preference in pasty or liquid, in particular water-containing, washing or cleaning agents according to the present invention. Washing or cleaning agents such as laundry post-treatment agents, for example fabric softeners, according to the present invention can also, if applicable, be free of organic builder.

Possibilities as water-soluble inorganic builder materials are, in particular, alkali silicates and polyphosphates, by preference sodium triphosphate. Crystalline or amorphous alkali aluminosilicates are optionally used in particular as water-insoluble, water-dispersible inorganic builder materials, in quantities of e.g. up to 50 wt %, by preference not above 40 wt %, and in liquid agents in particular from 1 wt % to 5 wt %, in the washing or cleaning agents according to the present invention. Among these, the crystalline sodium aluminosilicates of washing-agent quality, in particular zeolite A, P, and if applicable X, are preferred. Quantities close to the aforesaid upper limit are optionally used by preference in solid, particulate agents. Suitable substitutes respectively partial substitutes for the aforesaid aluminosilicate are crystalline alkali silicates, which can be present alone or mixed with amorphous silicates. The alkali silicates usable in the washing or cleaning agents according to the present invention as builders have by preference a molar ratio of alkali oxide to $SiO_2$ below 0.95, in particular from 1:1.1 to 1:12, and can be present in amorphous or crystalline fashion. Amorphous alkali silicates are preferred.

It is also preferred for purposes of a further preferred embodiment to use at most a small quantity of water-insoluble builder materials (such as e.g. zeolite), for example in quantities from 0 to 5 wt %, e.g. 0.1 to 2 wt %, based on the entire washing or cleaning agent.

Builder substances are optionally contained in the washing or cleaning agents according to the present invention by preference in quantities of up to 60 wt %, in particular from 5 wt % to 40 wt %. Laundry post-treatment agents, for example fabric softeners, according to the present invention are by preference free of inorganic builder.

Optionally usable peroxygen compounds that are suitable are, in particular, organic peracids respectively peracid salts of organic acids such as phthalimidopercapronic acid, perbenzoic acid, or salts of diperdodecanedioic acid, hydrogen peroxide, and inorganic salts that release hydrogen peroxide under utilization conditions, such as perborate, percarbonate, and/or persilicate. If solid peroxygen compounds are to be used, they can be utilized in the form of powders or granulates, which in principle can also be encased in known fashion. Alkali percarbonate, alkali perborate monohydrate, or (in particular in liquid agents) hydrogen peroxide in the form of aqueous solutions that contain 3 wt % to 10 wt % hydrogen peroxide, can be used with particular preference. If a washing or cleaning agent according to the present invention contains bleaching agents, such as preferably peroxygen compounds, the latter are present in quantities of preferably up to 50 wt %, in particular from 5 wt % to 30 wt %. The optional addition of small quantities of known bleaching-agent stabilizers, for example phosphonates, borates or metaborates, and metasilicates, as well as magnesium salts such as magnesium sulfate, may be useful.

Compounds that, under perhydrolysis conditions, yield aliphatic peroxocarboxylic acids having by preference 1 to 10 carbon atoms, in particular 2 to 4 carbon atoms, and/or (optionally substituted) perbenzoic acid, can optionally be used as bleach activators. Substances that carry the O- and/or N-acyl groups having the aforesaid number of carbon atoms, and/or optionally substituted benzoyl groups, are suitable. Multiply acylated alkylenediamines, in particular tetraacetylethylendiamine (TAED), acylated triazine derivatives, in particular 1,5-diacetyl-2,4-dioxohexahydro-1,3,5-triazine (DADHT), acylated glycolurils, in particular tetraacetyl glycoluril (TAGU), N-acylimides, in particular N-nonanoyl succinimide (NOSI), acylated phenolsulfonates, in particular n-nonanoyl or isononanoyl oxybenzenesulfonate (iso-NOBS), carboxylic acid anhydrides, in particular phthalic acid anhydride, acylated polyvalent alcohols, in particular triacetin, ethylene glycol diacetate, 2,5-diacetoxy-2,5-dihydrofuran, and enol esters, as well as acetylated sorbitol and mannitol respectively mixtures thereof, acylated sugar derivatives, in particular pentaacetylglucose (PAG), pentaacetylfructose, tetraacetylxylose and octaacetyllactose, as well as acetylated, optionally N-alkylated glucamine and gluconolactone, and/or N-acylated lactams, for example N-benzoylcaprolactam, are preferred. Hydrophilically substituted acyl acetates and acyl lactams are likewise used in preferred fashion. Combinations of conventional bleach activators can also be used. Such bleach activators can be contained in the usual quantity range, by preference in quantities from 1 wt % to 10 wt %, in particular 2 wt % to 8 wt %, based on the total agent.

The washing or cleaning agents can optionally contain as optical brighteners, for example, derivatives of diaminostilbenesulfonic acid or alkali-metal salts thereof. Suitable, for example, are salts of 4,4'-bis(2-anilino-4-morpholino-1,3,5-triazinyl-6-amino)stilbene-2,2'-disulfonic acid, or compounds of similar structure that carry, instead of the morpholino group, a diethanolamino group, a methylamino group, an anilino group, or a 2-methoxyethylamino group. Brighteners of the substituted diphenylstyryl type can also be present, e.g. the alkali salts of 4,4'-bis(2-sulfostyryl)diphenyl, of 4,4'-bis(4-chloro-3-sulfostyryl)diphenyl, or of 4-(4-chlorostyryl)-4'-(2-sultostyryl)diphenyl. Mixtures of the aforesaid brighteners can also be used.

Included among the optionally usable foam inhibitors are, for example, organopolysiloxanes and mixtures thereof with microfine, optionally silanated silicic acid, as well as paraffin waxes and mixtures thereof with silanated silicic acid or bis-fatty acid alkylenediamides. Mixtures of different foam inhibitors, for example those made of silicones, paraffins, or waxes, can also be used with advantage. The optional foam inhibitors, in particular silicone- and/or paraffin-containing foam inhibitors, are by preference bound to a granular carrier substance that is soluble respectively dispersible in water. Mixtures of paraffins and bistearylethylenediamides are particularly preferred in this context.

In addition, the washing or cleaning agents can optionally also contain components that positively influence the ability of oils and fats to be washed out of textiles (so-called "soil-release active substances" or "soil repellents"). This effect becomes particularly apparent when the soiled textile is one that has already been previously washed several times with a washing agent that contains this oil- and fat-releasing component. The preferred oil- and fat-releasing components include, for example, nonionic cellulose ethers such as methyl cellulose and methylhydroxypropyl cellulose having a 15 to 30 wt % proportion of methoxyl groups and a 1 to 15 wt % proportion of hydroxypropoxyl groups, based in each case on the nonionic cellulose ethers, as well as polymers, known from the existing art, of phthalic acid and/or terephthalic acid or of their derivatives with monomeric and/or polymeric diols, in particular polymers of ethylene terephthalates and/or polyethylene glycol terephthalates or anionically and/or nonionically modified derivatives thereof.

The washing or cleaning agents can optionally also contain color transfer inhibitors, by preference in quantities from 0.1 wt % to 2 wt %, in particular 0.1 wt % to 1 wt %, which in a preferred embodiment of the invention are polymers of vinylpyrrolidone, vinylimidazole, vinylpyridine-N-oxide, or copolymers thereof. Also usable are both polyvinylpyrrolidones, N-vinylimidazole/N-vinylpyrrolidone copolymers, polyvinyloxazolidones, copolymers based on vinyl monomers and carboxylic acid amides, pyrrolidone-group-containing polyesters and polyamides, grafted polyamidoamines and polyethylenimines, polymers having amide groups made up of secondary amines, polyamine-N-oxide polymers, polyvinyl alcohols, and copolymers based on acrylamidoalkenylsulfonic acids.

The optionally usable anti-gray agents have the ability to keep dirt that has been detached from the textile fibers suspended in the bath. Water-soluble colloids, usually organic in nature, are suitable for this, for example starch, size, gelatin, salts of ethercarboxylic or ethersulfonic acids of starch or of cellulose, or salts of acid sulfuric-acid esters of cellulose or of starch. Water-soluble polyamides containing acid groups are also suitable for this purpose. Starch derivatives other than those recited above can also be used, for example aldehyde starches. Cellulose ethers such as carboxymethyl cellulose (sodium salt), methyl cellulose, hydroxyalkyl cellulose, and mixed ethers such as methylhydroxyethyl cellulose, methylhydroxypropyl cellulose, methylcarboxymethyl cellulose, and mixtures thereof can preferably be used, for example in quantities from 0.1 to 5 wt % based on the washing or cleaning agent, as optional anti-gray agents.

Included among the organic solvents optionally usable in the washing or cleaning agents according to the present invention, especially when the latter are present in liquid or pasty form, are alcohols having 1 to 4 carbon atoms, in particular methanol, ethanol, isopropanol, and tert-butanol, diols having 2 to 4 carbon atoms, in particular ethylene glycol and propylene glycol, as well as mixtures thereof, and the ethers derivable from the aforesaid compound classes. Water-miscible solvents of this kind can optionally be present in the washing or cleaning agents according to the present invention by preference in quantities not above 30 wt %, in particular from 6 wt % to 20 wt %.

In order to establish a desired pH that does not result of itself from mixture of the other components, the washing or cleaning agents according to the present invention can optionally contain acids, in particular citric acid, acetic acid, tartaric acid, malic acid, lactic acid, glycolic acid, succinic acid, glutaric acid, and/or adipic acid, but also mineral acids, in particular sulfuric acid, or bases, in particular ammonium hydroxides or alkali hydroxides. pH regulators of this kind can optionally be contained in the washing or cleaning agents according to the present invention in quantities by preference not above 20 wt %, in particular from 1.2 wt % to 17 wt %.

In a further embodiment of the invention, the washing or cleaning agent is characterized in that it is present in solid form, in particular as a pourable powder or as a shaped element; or it is present in liquid, gel, or paste form.

A "solid form" is understood as any solid, i.e. non-liquid or non-flowable formulation form, for example powders, shaped elements, granulates, or extrudates.

A solid agent according to the present invention can be present, for example, as a pourable powder, in particular having a bulk density from 300 g/l to 1200 g/l, in particular 500 g/l to 900 g/l or 600 g/l to 850 g/l.

A solid agent according to the present invention, in particular an automatic dishwashing agent, can further be present in the form of a shaped element, in particular a compactate, principally a tablet. The shaped element can also be, for example, a granulate that is contained in a bag or in a casting mold.

Agents according to the present invention can be formulated as single-phase or multi-phase products. Agents according to the present invention, in particular automatic dishwashing agents, having one, two, three, or four phases are preferred. Automatic dishwashing agents characterized in that they are present in the form of a prefabricated dispensing unit having two or more phases are likewise particularly preferred. Two-phase or multi-phase tablets in particular, for example two-layer tablets, in particular two-layer tablets having a recess and a shaped element located in the recess, are particularly preferred.

Automatic dishwashing agents according to the present invention are preferably pre-formulated into dispensing units. These dispensing units preferably comprise the quantity of substances having washing or cleaning activity that is necessary for one cleaning cycle. Preferred dispensing units have a weight between 12 and 30 g, preferably between 14 and 26 g, and in particular between 15 and 22 g. With particular preference, the volume of the aforesaid dispensing units, and their three-dimensional shape, are selected so that dispensability of the pre-formulated units via the dispensing chamber of an automatic dishwasher is guaranteed. The volume of the dispensing unit is therefore preferably between 10 and 35 ml, by preference between 12 and 30 ml, and in particular between 15 and 25 ml.

The agents according to the present invention, in particular the prefabricated dispensing agents, can further comprise a water-soluble envelope.

The manufacture of solid agents according to the present invention presents no difficulties and can occur in known fashion, for example by spray-drying or granulation; enzymes and any further thermally sensitive ingredients, such as e.g. bleaching agents, can if applicable be added separately later. A method comprising an extrusion step is preferred for the manufacture of agents according to the present invention having an elevated bulk weight, in particular in the range from 650 g/l to 950 g/l.

The manufacture of shaped elements according to the present invention, in particular of cleaning-agent tablets, occurs preferably in the manner known to one skilled in the art, by compressing particulate starting substances. For manufacture of the tablets, the premix is compacted in a so-called mold between two dies, yielding a solid compressed body. This operation, which will be referred to hereinafter for brevity's sake as "tableting," is subdivided into four portions: metering, compaction (elastic deformation), plastic deformation, and ejection. Tableting is by preference performed on so-called rotary presses.

In the context of tableting with rotary presses, it has proven advantageous to perform tableting with the smallest possible fluctuations in tablet weight. This also allows fluctuations in tablet hardness to be reduced. Weight fluctuations can be minimized in the following fashion:

- use of plastic inserts having small thickness tolerances
- low rotor rotation speed
- large filling shoes
- coordination between filling shoe blade speed and rotor rotation speed
- constant powder height in the filling shoe
- decoupling of filling shoe and powder supply.

The ingredients provided for tableting can be introduced into the mold simultaneously in the form of a common particulate premix, or simultaneously or in time-offset fashion in the form of individual, separate powders or granulates; metering of a prefabricated particulate premix is preferred.

It has been found according to the present invention, surprisingly, that the granulates used to manufacture the shaped elements can be compacted particularly effectively. It is thus possible, by preference utilizing a pressing force from 40 to 65 kN, particularly preferably from 48 to 60 kN, to obtain compactates having a hardness in the range from 150 to 250 N, in particular in the range from 200 to 230 N, which moreover exhibit particularly good pouring behavior. The granulates can thus preferably be compacted with relatively low pressing force into compactates of relatively high hardness, which moreover preferably exhibit very good pouring behavior. Conversely, it is correspondingly advantageous that the manufacture of compactates of lower hardness preferably requires a lower pressing force than for the manufacture of usual compactates.

In a further embodiment of the invention, an agent according to the present invention is characterized in that it is present in a liquid, gelled, or pasty form.

All liquid or flowable administration forms can serve in this context as liquid washing or cleaning agents. Agents that are pourable and can have viscosities of up to several tens of thousands of mPas are "flowable" for purposes of the present application. The viscosity can be measured with usual standard methods (e.g. Brookfield LVT-II viscosimeter at 20 rpm and 20° C., spindle 3), and is preferably in the range from 5 to 10,000 mPas. Preferred agents have viscosities from 10 to 8000 mPas, values between 120 and 3000 mPas being particularly preferred. A liquid washing or cleaning agent in the context of the present invention can therefore also be gel-like or paste-like; it can be present as a homogeneous solution or suspension, and can, for example, be sprayable or can be formulated in other usual administration forms.

Liquid or pasty agents according to the present invention in the form of usual solvent-containing solutions are manufactured as a rule by simply mixing the ingredients, which can be placed into an automatic mixer as substance or as solution.

Embodiments of the present invention thus comprise all solid, powdered, liquid, gelled, or pasty administration forms of the agents, which optionally can also be made up of multiple phases and can be present in compressed or uncompressed form. An agent according to the present invention can furthermore be packaged in a container, by preference an air-permeable container, from which it is released shortly before use or during the cleaning operation.

Washing or cleaning agents according to the present invention can contain exclusively one or more enzymes in the form of the enzyme granulate described. Alternatively, they can also contain further hydrolytic enzymes, or other enzymes, in a concentrate useful for the effectiveness of the agent. A further subject of the invention is thus represented by agents that further comprise one or more additional enzymes, all enzymes established in the existing art for these purposes being usable in principle. Preferably usable as further enzymes are all enzymes that can display catalytic activity in the agent according to the present invention, in particular a protease, amylase, cellulase, hemicellulase, mannanase, pectin-cleaving enzyme, tannase, xylanase, xanthanase, ▭-glucosidase, carrageenase, perhydrolase, oxidase, oxidoreductase, or a lipase, as well as preferably mixtures thereof. Agents according to the present invention contain enzymes by preference in total quantities from $1\times10^{-8}$ to 5 weight percent, based on active protein. The enzymes are contained in agents according to the present invention preferably from 0.001 to 5 wt %, more preferably from 0.01 to 5 wt %, even more preferably from 0.05 to 4 wt %, and particularly preferably from 0.075 to 3.5 wt %, in which context each enzyme that is contained can be present at the aforesaid quantitative ratios.

A preferred washing or cleaning agent according to the present invention is a solid, in particular powdered washing agent that can by preference contain, besides the enzyme granulate, components that are by preference selected from the following:

(a) anionic surfactants such as, by preference, alkylbenzenesulfonate, alkyl sulfate, e.g. in quantities by preference from 5 to 30 wt %,
(b) nonionic surfactants such as, by preference, fatty alcohol polyglycol ethers, alkylpolyglucoside, fatty acid glucamide, e.g. in quantities by preference from 0.5 to 15 wt %,
(c) builders such as e.g. polycarboxylate, sodium citrate, in quantities e.g. from 0 to 70 wt %, advantageously 0.5 to 60 wt %, by preference 0.75 to 55 wt %, in particular 1 to 40 wt %,
(d) alkalis such as e.g. sodium carbonate, in quantities e.g. from 0 to 35 wt %, advantageously 1 to 33 wt %, by preference 2 to 30 wt %, in particular 5 to 25 wt %,
(e) bleaching agents such as e.g. sodium perborate or sodium percarbonate, in quantities e.g. from 1 to 30 wt %, advantageously 1 to 25 wt %, by preference 1 to 20 wt %,
(f) corrosion inhibitors, e.g. sodium silicate, in quantities e.g. from 0 to 15 wt %, advantageously 1 to 14 wt %, by preference 2 to 12 wt %, in particular 3 to 11 wt %,
(g) stabilizers, e.g. phosphonates, advantageously 0 to 5 wt %,
(h) foam inhibitor, e.g. soap, silicone oils, paraffins, advantageously 0 to 4 wt %, by preference 0.1 to 3 wt %, in particular 0.2 to 2 wt %,
(i) optionally further enzymes, e.g. protease, amylase, cellulase, mannanase, pectin-cleaving enzyme, lipase, advantageously 0 to 8 wt %, by preference 0.2 to 6 wt %, in particular 0.3 to 4 wt %,
(j) anti-gray agent, e.g. carboxymethyl cellulose, advantageously 0 to 2 wt %,
(k) discoloration inhibitor, e.g. polyvinylpyrrolidone derivatives, e.g. 0 to 2 wt %,
(l) adjusting agent, e.g. sodium sulfate, advantageously 0 to 70 wt %, (m) optical brightener, e.g. stilbene derivative, biphenyl derivative, advantageously 0 to 0.4 wt %, in particular 0.1 to 0.3 wt %,
(n) optionally fragrances,
(O) optionally water,
(p) optionally soap,
(q) optionally bleach activators,
(r) optionally cellulose derivatives,
(s) optionally soil repellents,
"wt %" being based in each case on the total agent.

In a further preferred embodiment, the washing or cleaning agent according to the present invention is in solid form, in particular particulate form, and besides the enzyme granulate also contains 0 wt % to 55 wt % builders, 2.5 wt % to 20 wt % anionic surfactant, 1 wt % to 20 wt % nonionic surfactant, 1 wt % to 25 wt % bleaching agent, 0.5 wt % to 8 wt % bleach activator, and 0.1 wt % to 40 wt % adjusting agent, in particular alkali sulfate, as well as up to 2 wt %, in particular 0.4 wt % to 5 wt % further enzyme, by preference enzyme formulated in particulate form, in particular protease, lipase, amylase, cellulase, mannanase, pectin-cleaving enzyme, and/or oxidoreductase. This embodiment can optionally also be free of bleaching agent and bleach activator.

In another preferred embodiment of the invention, the washing or cleaning agent according to the present invention is present in liquid form, by preference in gel form. Preferred liquid washing or cleaning agents have water contents of, for example, 1.5 to 95 wt %, by preference 20 to 80 wt %, and in particular 20 to 70 wt %, based on the total agent. In the case of liquid concentrates the water content can also be particularly low, e.g. ≤30 wt %, by preference ≤20 wt %, in particular ≤15 wt %, such as e.g. 0.1 to 10 wt %, "wt %" being based in each case on the total agent. The liquid agents can also contain non-aqueous solvents.

A preferred washing or cleaning agent according to the present invention is a liquid, in particular gel-type, washing agent that by preference can contain, besides the enzyme granulate, components that are selected by preference from the following:

anionic surfactants such as, by preference, alkylbenzenesulfonate, alkyl sulfate, e.g. in quantities by preference from 5 to 40 wt %,
nonionic surfactants such as, by preference, fatty alcohol polyglycol ethers, alkylpolyglucoside, fatty acid glucamide, e.g. in quantities by preference from 0.5 to 25 wt %,
builders such as e.g. polycarboxylate, sodium citrate, advantageously 0 to 25 wt %, by preference 0.01 to 22 wt %, in particular 0.1 to 15 wt %,
foam inhibitor, e.g. silicone oils, paraffins, in quantities e.g. from 0 to 10 wt %, advantageously 0.1 to 4 wt %, by preference 0.2 to 2 wt %, in particular 1 to 3 wt %,
optionally further enzymes, e.g. protease, amylase, cellulase, lipase, mannanase, pectin-cleaving enzyme, lipase, in quantities e.g. from 0 to 10 wt %, advantageously 0.1 to 8 wt %, by preference 0.2 to 6 wt %, in particular 0.3 to 4.4 wt %,
optical brightener, e.g. stilbene derivative, biphenyl derivative, in quantities e.g. from 0 to 1 wt %, advantageously 0.1 to 0.3 wt %, in particular 0.1 to 0.4 wt %,
optionally fragrances,
water,
optionally soap, in quantities e.g. from 0 to 25 wt %, advantageously 1 to 20 wt %, by preference 2 to 15 wt %, in particular 3 to 10 wt %,
optionally solvents (by preference alcohols), advantageously 0 to 25 wt %, by preference 1 to 20 wt %, in particular 2 to 15 wt %, "wt %" being based in each case on the total agent.

A particularly preferred liquid washing or cleaning agent contains, besides the enzyme granulate, at least anionic surfactants in quantities from 0.5 wt % to 20 wt %, nonionic surfactants in quantities from 1 wt % to 25 wt %, builders in quantities from 1 to 25 wt %, enzymes, and water.

Some examples of formulas for preferred automatic dishwashing-agent tablets according to the present invention may be gathered from the tables below:

| Ingredient | Formula 1 (wt %) | Formula 2 (wt %) | Formula 3 (wt %) | Formula 4 (wt %) |
|---|---|---|---|---|
| Tripolyphosphate | 5 to 50 | 15 to 40 | — | — |
| Citrate | — * | — | 5 to 40 | 15 to 30 |
| Carbonate | 2 to 45 | 2 to 35 | 2 to 45 | 2 to 35 |
| Enzyme ** | 0.2 to 10 | 0.2 to 10 | 0.5 to 8 | 0.5 to 8 |
| Anionic copolymer C [3] | 0.5 to 18 | 0.5 to 18 | 0.5 to 18 | 0.5 to 18 |
| Misc. | to 100 | to 100 | to 100 | to 100 |

| Ingredient | Formula 5 (wt %) | Formula 6 (wt %) | Formula 7 (wt %) | Formula 8 (wt %) |
|---|---|---|---|---|
| Tripolyphosphate | 5 to 50 | 15 to 40 | — | — |
| Citrate | — * | — | 5 to 40 | 15 to 30 |
| Carbonate | 2 to 45 | 2 to 35 | 2 to 45 | 2 to 35 |
| Enzyme ** | 0.2 to 10 | 0.2 to 10 | 0.5 to 8 | 0.5 to 8 |
| Anionic copolymer C [3] | 0.5 to 18 | 0.5 to 18 | 0.5 to 18 | 0.5 to 18 |
| Misc. | to 100 | to 100 | to 100 | to 100 |

| Ingredient | Formula 9 (wt %) | Formula 10 (wt %) | Formula 11 (wt %) | Formula 12 (wt %) |
|---|---|---|---|---|
| Tripolyphosphate | 5 to 50 | 15 to 40 | — | — |
| Citrate | — * | — | 5 to 40 | 15 to 30 |
| Carbonate | 2 to 45 | 2 to 35 | 2 to 45 | 2 to 35 |
| Enzyme ** | 0.2 to 10 | 0.2 to 10 | 0.5 to 8 | 0.5 to 8 |
| Nonionic surfactant A [1] | 0.05 to 10 | 0.05 to 10 | 0.05 to 10 | 0.05 to 10 |
| Nonionic surfactant B [2] | 1 to 10 | 1 to 10 | 1 to 10 | 1 to 10 |
| Anionic copolymer C [3] | 0.5 to 18 | 0.5 to 18 | 0.5 to 18 | 0.5 to 18 |
| Misc. | to 100 | to 100 | to 100 | to 100 |

-continued

| Ingredient | Formula 13 (wt %) | Formula 14 (wt %) | Formula 15 (wt %) | Formula 16 (wt %) |
|---|---|---|---|---|
| Tripolyphosphate | 5 to 50 | 15 to 40 | — | — |
| Citrate | — * | — | 5 to 40 | 15 to 30 |
| Carbonate | 2 to 45 | 2 to 35 | 2 to 45 | 2 to 35 |
| Enzyme ** | 0.2 to 10 | 0.2 to 10 | 0.5 to 8 | 0.5 to 8 |
| Nonionic surfactant A [1] | 0.05 to 10 | 0.05 to 10 | 0.05 to 10 | 0.05 to 10 |
| Nonionic surfactant B [2] | 1 to 10 | 1 to 10 | 1 to 10 | 1 to 10 |
| Anionic copolymer C [3] | 0.5 to 18 | 0.5 to 18 | 0.5 to 18 | 0.5 to 18 |
| Misc. | to 100 | to 100 | to 100 | to 100 |

| Ingredient | Formula 17 (wt %) | Formula 18 (wt %) | Formula 19 (wt %) | Formula 20 (wt %) |
|---|---|---|---|---|
| Tripolyphosphate | 5 to 50 | 15 to 40 | — | — |
| Citrate | — * | — | 5 to 40 | 15 to 30 |
| Carbonate | 2 to 45 | 2 to 35 | 2 to 45 | 2 to 35 |
| Anionic copolymer C [3a] | 0.5 to 18 | 0.5 to 18 | 0.5 to 18 | 0.5 to 18 |
| Sodium percarbonate | 2 to 30 | 2 to 30 | 4 to 20 | 4 to 20 |
| Bleach catalyst | 0 to 2 | 0.0025 to 1 | 0 to 2 | 0.0025 to 1 |
| Misc. | to 100 | to 100 | to 100 | to 100 |

| Ingredient | Formula 21 (wt %) | Formula 22 (wt %) | Formula 23 (wt %) | Formula 24 (wt %) |
|---|---|---|---|---|
| Tripolyphosphate | 5 to 50 | 15 to 40 | — | — |
| Citrate | — * | — | 5 to 40 | 15 to 30 |
| Carbonate | 2 to 45 | 2 to 35 | 2 to 45 | 2 to 35 |
| Nonionic surfactant A [1a] | 0.05 to 10 | 0.05 to 10 | 0.05 to 10 | 0.05 to 10 |
| Nonionic surfactant B [2] | 1 to 10 | 1 to 10 | 1 to 10 | 1 to 10 |
| Anionic copolymer C [3a] | 0.5 to 18 | 0.5 to 18 | 0.5 to 18 | 0.5 to 18 |
| Sodium percarbonate | 2 to 30 | 2 to 30 | 4 to 20 | 4 to 20 |
| Bleach catalyst | 0 to 2 | 0.0025 to 1 | 0 to 2 | 0.0025 to 1 |
| Misc. | to 100 | to 100 | to 100 | to 100 |

| Ingredient | Formula 25 (wt %) | Formula 26 (wt %) | Formula 27 (wt %) | Formula 28 (wt %) |
|---|---|---|---|---|
| Tripolyphosphate | 5 to 50 | 15 to 40 | — | — |
| Citrate | — * | — | 5 to 40 | 15 to 30 |
| Carbonate | 2 to 45 | 2 to 35 | 2 to 45 | 2 to 35 |
| Anionic copolymer C [3a] | 0.5 to 18 | 0.5 to 18 | 0.5 to 18 | 0.5 to 18 |
| Sodium percarbonate | 2 to 30 | 2 to 30 | 4 to 20 | 4 to 20 |
| Bleach catalyst | 0 to 2 | 0.0025 to 1 | 0 to 2 | 0.0025 to 1 |
| Misc. | to 100 | to 100 | to 100 | to 100 |

| Ingredient | Formula 29 (wt %) | Formula 30 (wt %) | Formula 31 (wt %) | Formula 32 (wt %) |
|---|---|---|---|---|
| Tripolyphosphate | 5 to 50 | 15 to 40 | — | — |
| Citrate | — * | — | 5 to 40 | 15 to 30 |
| Carbonate | 2 to 45 | 2 to 35 | 2 to 45 | 2 to 35 |
| Nonionic surfactant A [1b] | 0.05 to 10 | 0.05 to 10 | 0.05 to 10 | 0.05 to 10 |
| Nonionic surfactant B [2] | 1 to 10 | 1 to 10 | 1 to 10 | 1 to 10 |
| Anionic copolymer C [3a] | 0.5 to 18 | 0.5 to 18 | 0.5 to 18 | 0.5 to 18 |
| Sodium percarbonate | 2 to 30 | 2 to 30 | 4 to 20 | 4 to 20 |

-continued

| | | | | |
|---|---|---|---|---|
| Bleach catalyst | 0 to 2 | 0.0025 to 1 | 0 to 2 | 0.0025 to 1 |
| Misc. | to 100 | to 100 | to 100 | to 100 |

[1] A nonionic surfactant of the general formula $R^1O(AlkO)_xM(OAlk)_yOR^2$, in which $R^1$ and $R^2$ mutually independently denote a branched or unbranched, saturated or unsaturated, optionally hydroxylated alkyl residue having 4 to 22 carbon atoms;

Alk denotes a branched or unbranched alkyl residue having 2 to 4 carbon atoms;

x and y mutually independently denote values between 1 and 70; and

M denotes an alkyl residue from the group $CH_2$, $CHR^3$, $CR^3R^4$, $CH_2CHR^3$, and $CHR^3CHR^4$, where $R^3$ and $R^4$ mutually independently denote a branched or unbranched, saturated or unsaturated alkyl residue having 1 to 18 carbon atoms.

[1a] A nonionic surfactant A of the general formula $R^1—CH(OH)CH_2—O(CH_2CH_2O)_xCH_2CHR(OCH_2CH_2)_yO—CH_2CH(OH)—R^2$ is used, in which R, $R^1$, and $R^2$ mutually independently denote an alkyl residue or alkenyl residue having 6 to 22 carbon atoms;

x and y mutually independently denote values between 1 and 40.

[1b] A nonionic surfactant A of the general formula $R^1—O(CH_2CH_2O)_xCR^3R^4(OCH_2CH_2)_yO—R^2$ is used, in which $R^1$ and $R^2$ mutually independently denote an alkyl residue or alkenyl residue having 4 to 22 carbon atoms;

$R^3$ and $R^4$ mutually independently denote hydrogen or an alkyl residue or alkenyl residue having 1 to 18 carbon atoms; and x and y mutually independently denote values between 1 and 40.

[2] A nonionic surfactant B that is different from nonionic surfactant A.

[3] An anionic polymer C from the group of the copolymeric polycarboxylates and copolymeric polysulfonates.

[3a] An anionic polymer C comprising i) carboxylic-acid-group-containing monomer(s)

ii) sulfonic-acid-group-containing monomer(s)

iii) optionally nonionic monomer(s).

* "—" means that the formula is free of this constituent.

** The enzyme is used as a corresponding enzyme granulate. In particular, the enzyme is a protease, amylase, cellulase, lipase, mannanase, a pectin-cleaving enzyme, or a lipase, or mixtures thereof, in particular a protease and/or an amylase.

Misc. Other further ingredients.

Further particularly preferred automatic dishwashing-agent tablets according to the present invention comprise formulas as indicated above, and further contain from 0.1 to 5 wt % polyvinylpyrrolidone particles.

A further preferred washing or cleaning agent according to the present invention is a liquid fabric softener that can by preference contain, besides the enzyme granulate, components that are selected from the following:

- cationic surfactants such as, in particular, esterquats, e.g. in quantities from 5 to 30 wt %,
- cosurfactants such as, in particular, glycerol monostearate, stearic acid, fatty alcohols, and/or fatty alcohol ethoxylates, e.g. in quantities from 0 to 5 wt %, by preference 0.1 to 4 wt %,
- emulsifiers such as, in particular, fatty amine ethoxylates, e.g. in quantities from 0 to 4 wt %, by preference 0.1 to 3 wt %,
- optionally further fragrances,
- optionally dyes, by preference in the ppm range,
- solvents such as, in particular, water, e.g. in quantities from 60 to 90 wt %, "wt %" being based in each case on the total agent.

A particularly preferred liquid fabric softener contains, besides at least one cationic surfactant, the enzyme granulate in quantities from 0.1 wt % to 12 wt %, as well as water.

EXAMPLE

Ascertaining the shelf stability of a washing agent according to the present invention A powdered washing agent having the composition below serves as a basic washing agent formula:

| | |
|---|---|
| Anionic surfactant (alkylbenzenesulfonate LAS) | 10 wt % |
| Nonionic surfactant (Lutensol ® AO7) | 3 wt % |
| Soap | 1 wt % |
| Sodium carbonate | 21 wt % |
| Phosphonate (HEDP) | 1 wt % |
| Polyacrylic acid, sodium salt | 2.5 wt % |

-continued

| | |
|---|---|
| Silicates | 5 wt % |
| Sodium sulfate | 38 wt % |
| Sodium percarbonate | 12 wt % |
| TAED | 3 wt % |
| Carboxymethyl cellulose | 1 wt % |
| Soil-release active substance (Texcare SRA 300F) | 0.5 wt % |
| Optical brightener | 0.3 wt % |
| Anti-foam agent, scents (total) | 1 wt % |
| Enzyme granulate (amylase) | 0.2 wt % |
| Further enzymes (protease, cellulase, mannanase, lipase) | to 100 wt % |

A variety of enzyme granulates were incorporated as an enzyme granulate for the various experimental batches, as indicated below. The enzyme contained in the granulates was the amylase Stainzyme Plus® (Novozymes company).

Batch 1: Washing agent having Stainzyme Plus® 12 T enzyme granulate (Novozymes company)

Batch 2: Washing agent according to the present invention having an enzyme granulate that had the following composition (all indications in wt % (w/w), based on the total granulate):

| | |
|---|---|
| Sodium sulfate | 71 |
| Amylase (dry substance content) | 6 |
| Cellulose | 8 |
| Calcium carbonate | 6 |
| Titanium dioxide | 3 |
| Sucrose | 3 |
| Dextrin | 2 |
| Polyethylene glycol | 0.8 |
| Kaolin | 0.4 |

The washing agents according to the respective batches 1 and 2 were checked with regard to their shelf stability. For this, the washing agents were stored at a temperature of 30° C. for the time period indicated in each case, and the respective residual amylolytic activity was determined. Under defined reaction conditions (tris-maleate buffer pH 6.5, 50° C., 15 min), the samples to be investigated were incubated with 0.67% starch (soluble, pretreated per Zulkowsky (treated with glycerol at 190° C.)). Adding dinitrosalicylic acid and heating to 100° C. caused this to be reduced by glucose and other reducing sugars under alkaline conditions to a red-orange dye, which was determined photometrically at a wavelength of 540 nm after completion of the reaction. The quantity of released sugar corresponding to the color is an indication of the enzyme activity (cf. Sumner et al., J. Biol. Chem., 1921, 47 and 1924, 62). The residual amylolytic activities obtained are indicated in Table 1 below.

TABLE 1

| Washing agent according to: | Initial | 4 weeks | 8 weeks |
|---|---|---|---|
| Batch 1 | 100% | 32% | 0% |
| Batch 2 | 100% | 96% | 64% |

It is apparent that washing agents according to the present invention exhibit improved residual enzymatic activity, and thus shelf stability, as compared with the control washing agent of batch 1.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A washing or cleaning agent comprising an enzyme granulate, the granulate comprising at least one core and at least one envelope surrounding the core, wherein the core comprises, besides the enzyme, the following components:

(a) 68 to 90 wt % (w/w) alkali metal sulfate, (b) 0.2 to 5.0 wt % (w/w) polyethylene glycol, (c) 0.5 to 14.5 wt % (w/w) granulation adjuvant wherein the agent has bulk density of from 500 g/L to 900 g/L.

2. The washing or cleaning agent according to claim 1, wherein the agent contains the enzyme granulate in a quantity from 0.01 to 20 wt % (w/w).

3. The washing or cleaning agent according to claim 1, wherein component (c) is selected from the group consisting of cellulose, sheet silicate, carboxymethyl cellulose, carboxymethyl starch, methyl cellulose, hydroxyethyl cellulose, hydroxypropyl cellulose, cellulose mixed ethers, gelatin, casein, tragacanth, maltodextrose, sucrose, invert sugar, glucose syrup, polyacrylate, polymethacrylate, copolymers of acrylic acid with maleic acid or vinyl-group-containing compounds, polyvinyl alcohol, partially saponified polyvinyl acetate, and polyvinylpyrrolidone.

4. The washing or cleaning agent according to claim 1, wherein the enzyme is present in the enzyme granulate in a quantity from 2 to 30 wt % (w/w).

5. The washing or cleaning agent according to claim 1, wherein the enzyme granulate further comprises a color pigment in a quantity from 2 to 6 wt % (w/w).

6. The washing or cleaning agent according to claim 1, wherein the enzyme granulate further comprises kaolin in a quantity from 0.1 to 2.5 wt % (w/w).

7. The washing or cleaning agent according claim 1, wherein the enzyme granulate is substantially free of carbonate.

8. The washing or cleaning agent according to claim 1, wherein the washing or cleaning agent comprises a further ingredient that is selected from the group consisting of surfactant, builder, bleaching agent, bleach activator, optical brightener, foam inhibitor, soil-release active substance, color transfer inhibitor, anti-gray agent, organic solvent, acid, and base.

9. The washing or cleaning agent according to claim 1, wherein the agent is present in solid form.

* * * * *